US011177082B2

(12) United States Patent
Rabb et al.

(10) Patent No.: US 11,177,082 B2
(45) Date of Patent: Nov. 16, 2021

(54) ELECTRICAL SWITCH WITH THREE FIXED CONTACTS, A ROTATING KNIFE CONTACT AND THREE SWITCH POSITIONS

(71) Applicant: ABB Schweiz AG, Baden (CH)

(72) Inventors: Patrik Rabb, Vaasa (FI); Rainer Kolmonen, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/907,552

(22) Filed: Jun. 22, 2020

(65) Prior Publication Data

US 2020/0402733 A1 Dec. 24, 2020

(51) Int. Cl.

| | |
|---|---|
| ***H01H 1/20*** | (2006.01) |
| ***H01H 1/06*** | (2006.01) |
| ***H01H 1/42*** | (2006.01) |
| ***H01H 3/16*** | (2006.01) |
| ***H01H 21/54*** | (2006.01) |
| ***H01H 9/02*** | (2006.01) |
| ***H01H 33/10*** | (2006.01) |

(52) U.S. Cl.

CPC ..... *H01H 1/2041* (2013.01); *H01H 1/06* (2013.01); *H01H 1/42* (2013.01); *H01H 3/161* (2013.01); *H01H 9/02* (2013.01); *H01H 21/54* (2013.01); *H01H 33/10* (2013.01)

(58) Field of Classification Search

CPC ..... H01H 1/2041; H01H 1/06; H01H 1/42; H01H 3/161; H01H 21/54; H01H 21/60

See application file for complete search history.

(56) References Cited

U.S. PATENT DOCUMENTS

| | | | | |
|---|---|---|---|---|
| 1,486,744 | A | 3/1924 | Hartzell | |
| 2020/0211789 | A1* | 7/2020 | Kolmonen | H01H 1/04 |
| 2020/0217892 | A1* | 7/2020 | Maki | H01H 1/2041 |
| 2020/0219671 | A1* | 7/2020 | Rabb | H01H 1/06 |
| 2020/0219673 | A1* | 7/2020 | Kolmonen | H01H 1/06 |

(Continued)

FOREIGN PATENT DOCUMENTS

| | | | |
|---|---|---|---|
| CN | 107919722 | A | 4/2018 |
| EP | 3457422 | A1 | 3/2019 |
| GB | 581122 | A | 10/1946 |

(Continued)

OTHER PUBLICATIONS

Finnish Patent Office, Search Report issued in corresponding Application No. 20195552, dated Feb. 3, 2020, 2 pp.

(Continued)

*Primary Examiner* — Vanessa Girardi

(74) *Attorney, Agent, or Firm* — Leydig, Voit & Mayer, Ltd.

(57) ABSTRACT

The electrical switch includes three fixed contacts and a rotatable knife contact being connected with a permanent electrical connection to a third one of the fixed contacts and including at least one pair of longitudinal blades. The rotatable knife contact connects in a first switching position only a first one and a third one of the fixed contacts electrically together, and in a second switching position only a second one and a third one of the fixed contacts. The rotatable knife contact connects further in a zero switching position the first, the second and the third fixed contact electrically together.

20 Claims, 5 Drawing Sheets

(56) References Cited

U.S. PATENT DOCUMENTS

Figure 1:
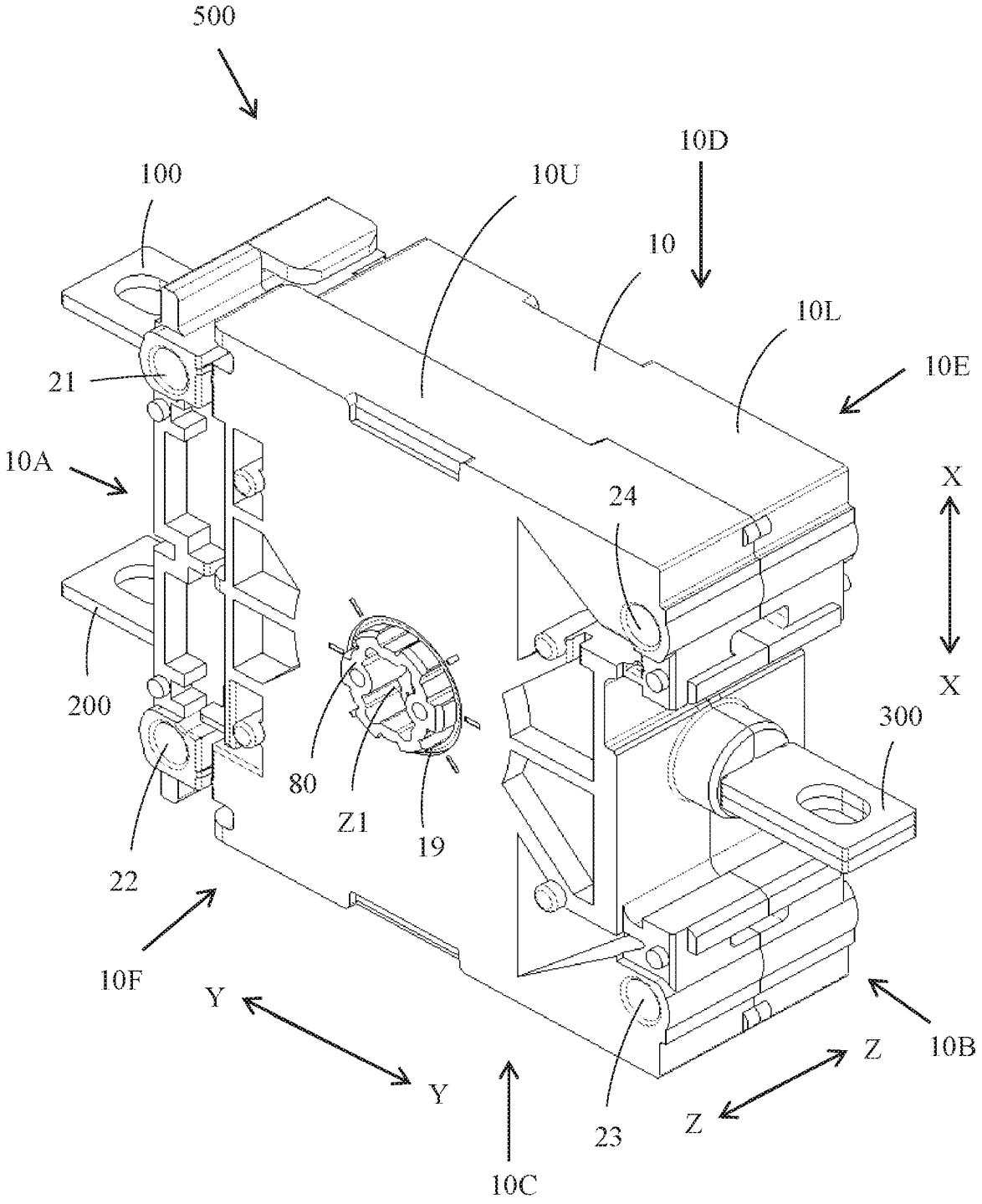

2020/0219683 A1* 7/2020 Rabb ..... H01H 1/365

FOREIGN PATENT DOCUMENTS

| | | | |
|---|---|---|---|
| WO | 2004032165 | A2 | 4/2004 |
| WO | 2019053333 | A1 | 3/2019 |
| WO | 2019053334 | A1 | 3/2019 |

OTHER PUBLICATIONS

"Transfer Switch," Wikipendia, Retrieved from Internet: https://en.wikipedia.org/w/index.php?title=Transfer_switch&oldid=895103592.

European Patent Office, Extended Search Report issued in corresponding Application No. 20180708.8, dated Oct. 26, 2020, 8 pp.

* cited by examiner

ELECTRICAL SWITCH WITH THREE FIXED CONTACTS, A ROTATING KNIFE CONTACT AND THREE SWITCH POSITIONS

FIELD

The invention relates to an electrical switch.

BACKGROUND

There are a variety of electrical switches on the market with fixed and movable contacts. The movable contacts make connections between the stationary contacts. A simple electrical switch may comprise two fixed contacts and one movable contact that performs coupling and disconnection between the two fixed contacts. A transfer switch may on the other hand comprise three fixed contacts and one movable contact. The movable contact in a transfer switch may connect alternatively the first fixed or the second fixed contact electrically to the third fixed contact. A transfer switch can be used in a situation where it is necessary to connect the load to a primary power supply or to a secondary power supply. Such a need is for example in hospitals where the primary power supply is the electrical grid and the secondary power supply is an emergency power plant. The load may thus be coupled to the third fixed contact and the primary power source to the first or second fixed contact and the secondary power source respectively to the second or the first fixed contact.

The electrical switches can be provided with bumper contacts or knife contacts. The contact in the bumper contact structure is pressed to the fixed contacts. In the knife contacts, the movable contact consists of two blades hinged at one end to a fixed contact and the other end acts as a separating part. The knife contact construction can also be implemented with two openings so that the blades are connected to a rotating roller or so that the blades move straight up and down. The knife contacts are normally used in switches designed for a nominal current over 63 ampere and bumper contacts are used in switches designed for smaller currents.

A transfer switch may comprise three fixed contacts and one movable contact. The movable contact may connect alternatively the first fixed or the second fixed contact electrically to the third fixed contact. The movable contact may thus be moved between a first switching position and a second switching position. The movable contact may connect in the first switching position only the first fixed contact electrically to the third fixed contact. The movable contact may on the other hand connect in the second switching position only the second fixed contact electrically to the third fixed contact.

A transfer switch may, however, also be used for connecting the neutral conductors between the line power and the reserve power. There may exist a need for an overlapping of neutral contacts during the movement of the movable contact between the switching positions. This may be called a make-before-break function of the electrical switch. The electrical switch makes a new connection before it breaks the previous connection.

Overlapping of neutral contacts means that there may exist a zero switching position in which the movable contact makes contact to the first fixed contact and to the second fixed contact at the same time when changing between the switching positions i.e. from the first switching position to the second switching position and vice a versa.

Such an overlapping of neutral contacts have in prior art solutions often been realized with separate linkages between the poles or the contacts.

SUMMARY

The invention relates to an improved electrical switch.

The electrical switch according to the invention is defined in claim 1.

The electrical switch comprises:

a first fixed contact, a second fixed contact, a third fixed contact, a rotatable knife contact being connected with a permanent electrical connection to the third fixed contact, the rotatable knife contact comprising at least one longitudinal pair of blades flexibly connected to each other with a spring structure, the rotatable knife contact having a first switching position in which a first outer end of the blades makes contact with the first fixed contact connecting only the first fixed contact and the third fixed contact electrically to each other, and a second switching position in which a second outer end of the blades makes contact with the second fixed contact connecting only the second fixed contact and the third fixed contact electrically to each other.

The electrical switch is characterized in that a contact portion of the first fixed contact comprises a contact area having the form of an arc and a contact portion of the second fixed contact comprises a contact area having the form of an arc, the outer ends of the blades of the rotatable knife contact making contact with said contact areas during the switching operation of the electrical switch, the rotatable knife contact has further a zero switching position between the first switching position and the second switching position in which zero switching position the first outer end of the blades makes contact with the contact area of the contact portion of the first fixed contact and the second outer end of the blades makes contact with the contact area of the contact portion of the second fixed contact connecting the first fixed contact, the second fixed contact and the third fixed contact electrically to each other.

The electrical switch may be a transfer switch in which both ends of the rotatable knife contact may be utilized to perform the switching operations.

The inventive solution for overlapping of neutral contacts in the switching events is simple and there is no need for extra parts in this solution. The solution is integrated into the construction of the electrical switch.

The contact force between the movable knife contact and the fixed contacts may be reduced during the overlapping in order to reduce the operation torque needed to rotate the movable knife contact. This may be done e.g. by reducing the thickness of the contact portion of the fixed contacts in the overlapping area of said fixed contacts.

The duration of the overlapping i.e. the overlapping time may easily be adjusted in the inventive solution. This may be done e.g. by adjusting the length of the contact portions of the fixed contacts.

DRAWINGS

Figure 2:
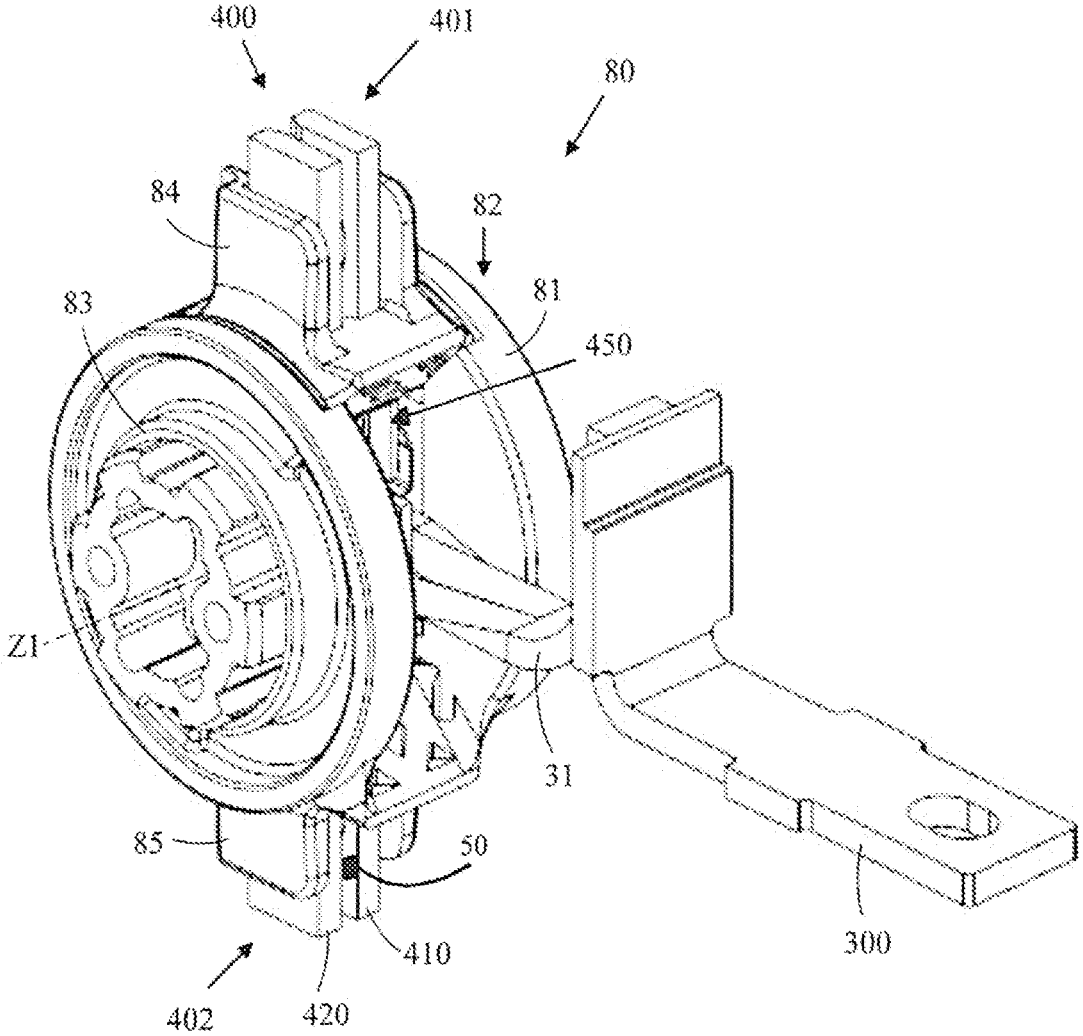
Figure 3:
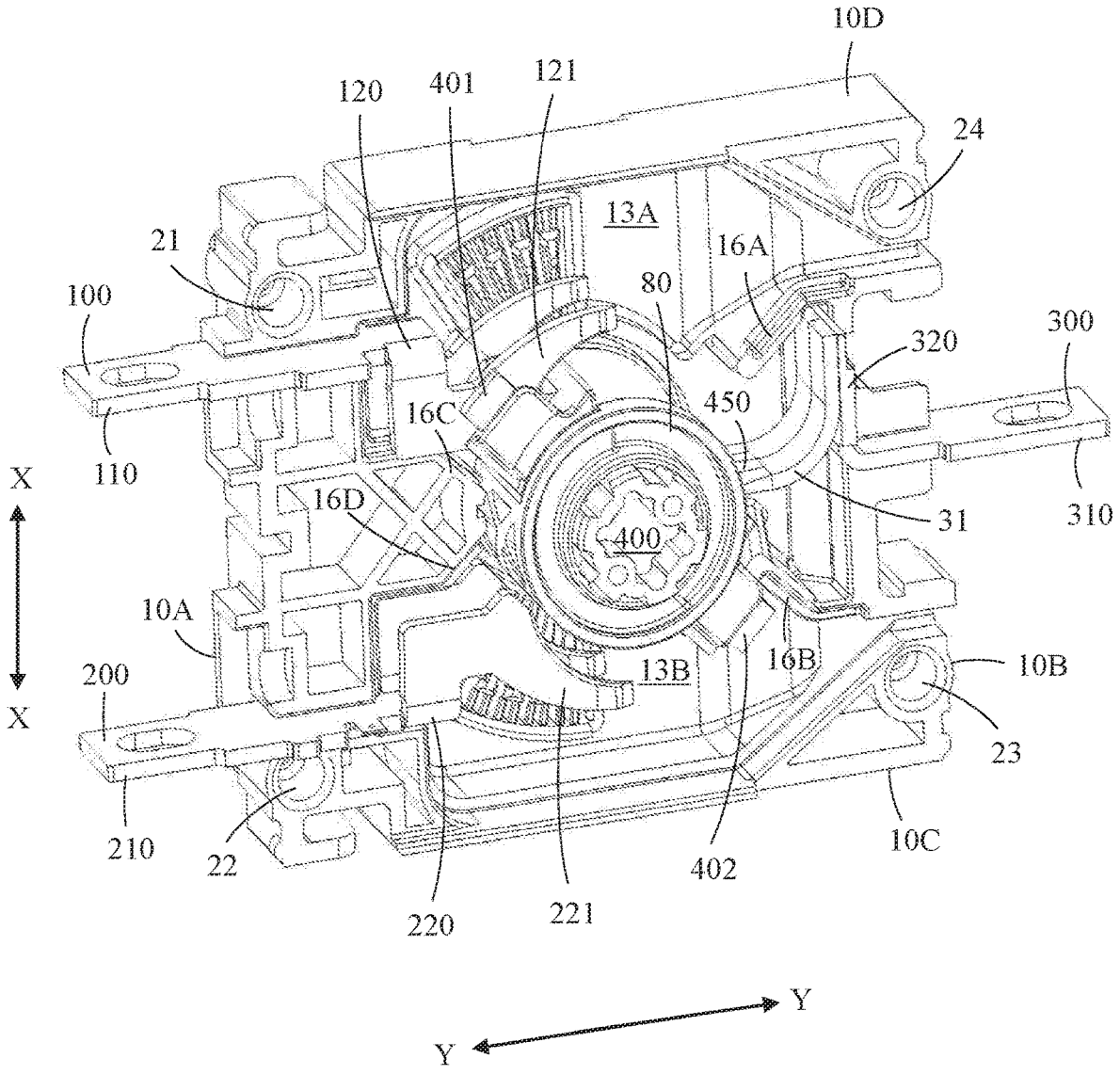
Figure 4:
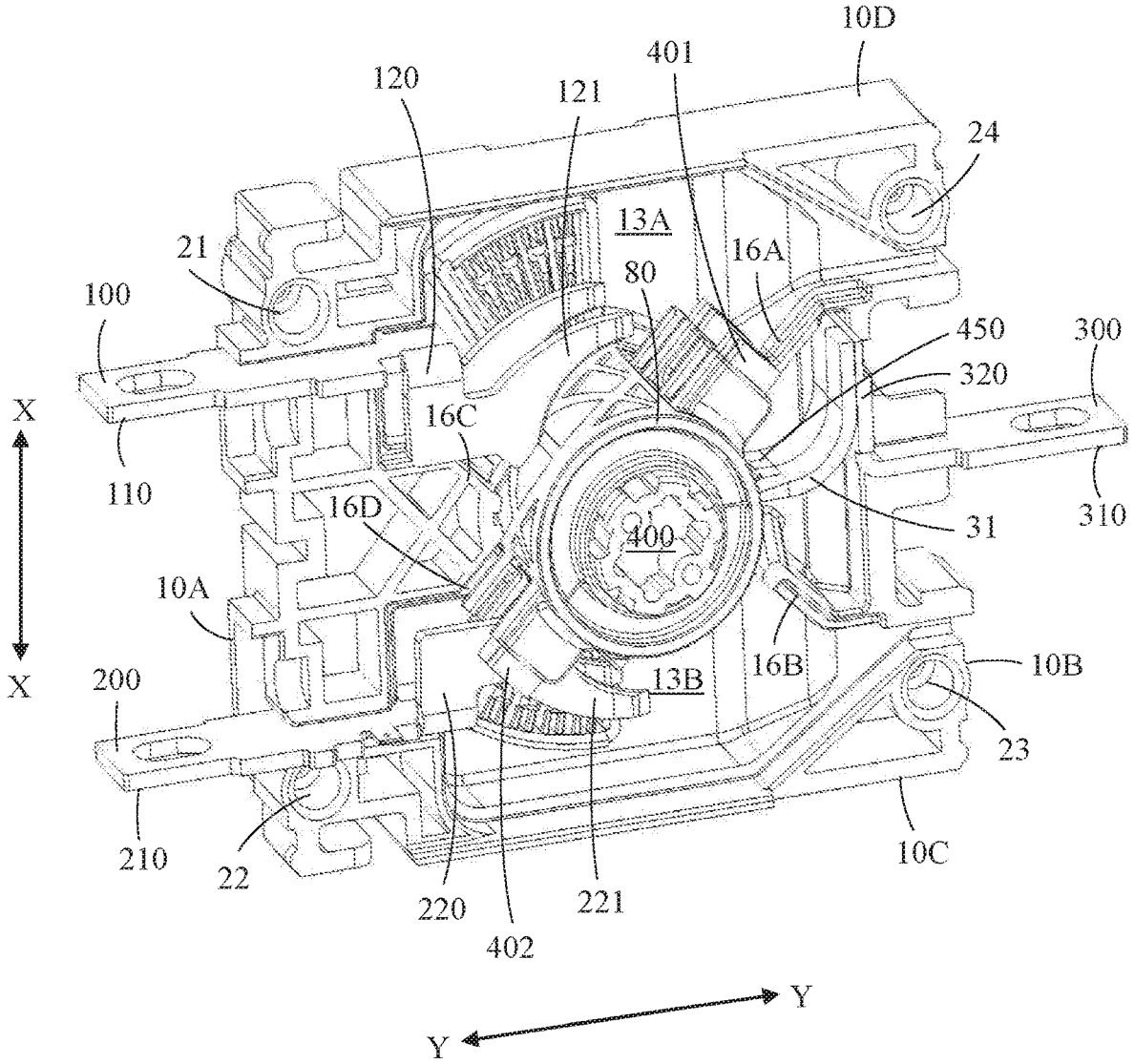
Figure 5:
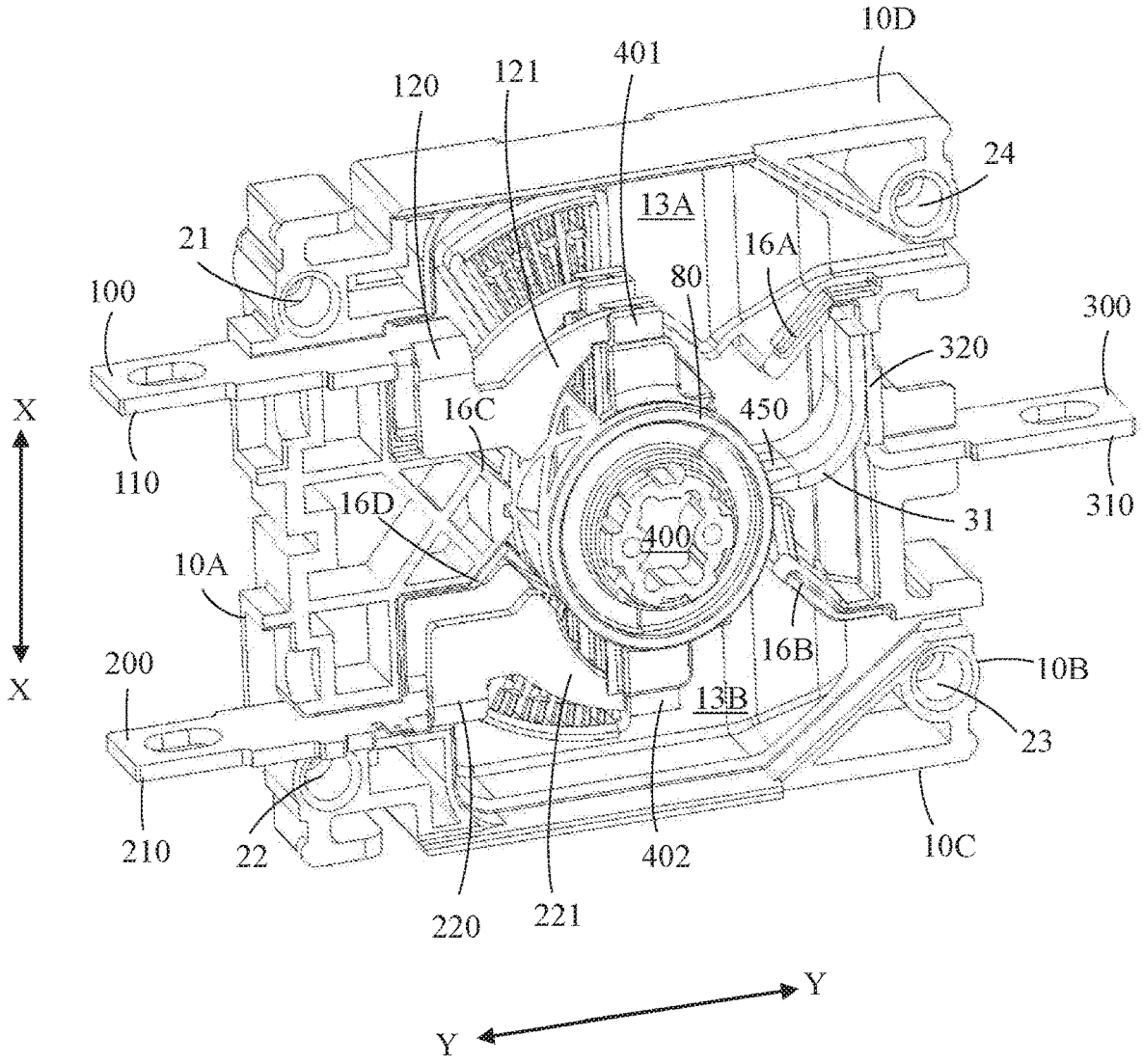

The invention will be described with reference to the accompanying drawings in which FIG. 1 shows an axonometric view of an electrical switch, FIG. 2 shows an exploded view of a rotatable knife contact and a roller of the electrical switch, FIG. 3 shows a view of the electrical switch in a first switching position with the rotatable knife contact in a first switching position and rotated into a position in which a first fixed contact and a third fixed contact are electrically connected to each other, FIG. 4 shows a view of the electrical switch in a second switching position with the rotatable knife contact in the second switching position and rotated into a position in which only the second fixed contact and the third fixed contact are electrically connected to each other, FIG. 5 shows a view of the electrical switch in a zero switching position with the rotatable knife contact in the zero switching position and rotated into a position in which the first fixed contact, the second fixed contact and the third fixed contact are electrically connected to each other.

DETAILED DESCRIPTION

FIG. 1 shows an axonometric view of an electrical switch.

The electric switch 500 may comprise a housing 10 having a longitudinal direction Y-Y, a height direction X-X perpendicular to the longitudinal direction Y-Y, and a thickness direction Z-Z perpendicular to the longitudinal direction Y-Y and to the height direction X-X. The height direction X-X and the thickness direction Z-Z form transverse directions in relation to the longitudinal direction Y-Y of the housing 10.

The housing 10 may consist of two halves 10L and 10U. The first half 10L of the housing 10 may be placed against the second half 10U of the housing 10 so that a substantially closed space is formed within the two halves 10L, 10U. Each half 10L of the housing 10 may comprise a side panel 10E, 10F and side walls 10A, 10B, 10C, 10D extending perpendicularly from the peripheral edges of the side panels 10E, 10F. The outer edges of the side walls 10A, 10B, 10C, 10D of the halves 10L, 10U of the housing 10 may be placed against each other when the halves 10L, 10U of the housing 10 are joined together. The outer edges of the side walls 10A, 10B, 10C, 10D of the halves 10L, 10U of the housing 10 may comprise nested projections, whereby the joint between the two halves 10L, 10U of the housing 10 can be made to sustain the pressure caused e.g. by arcs within the housing 10.

A first side wall 10A and a second side wall 10B of the housing 10 may be positioned spaced apart from each other in a longitudinal direction Y-Y of the housing 10. The first side wall 10A and the second side wall 10B may be positioned opposite to each other. The first and the second side walls 10A, 10B may extend in the height direction X-X and in the thickness direction Z-Z of the housing 10.

A third and a fourth side wall 10C, 10D of the housing 10 may connect the edges of the first side wall 10A and the second side wall 10B. The third side wall 10C and the fourth side wall 10D may be positioned opposite to each other. The third and the fourth side wall 10C, 10D may extend in the longitudinal direction Y-Y and in the thickness direction Z-Z of the housing 10.

The side panels 10E, 10F may be positioned spaced apart from each other in the thickness direction Z-Z of the housing 10. The side panels 10E, 10F may connect the opposite edges of the side walls 10A, 10B, 10C, 10D. The side panels 10E, 10F may extend in the longitudinal direction Y-Y and in the height direction X-X of the housing 10.

Each half 10L, 10U of the housing 10 may also be provided with mounting holes 21, 22, 23, 24 extending through the housing 10. The two halves 10L, 10U of the housing 10 may be secured to each other with mounting bolts and nuts extending through these mounting holes 21, 22, 23, 24. The first half 10L and the second half 10U of the housing 10 may further have adjustment means or adjustment surfaces for adjusting the two halves 10L, 10U in a correct position in relation to each other.

A first fixed contact 100, a second fixed contact 200, and a third fixed contact 300 may be provided in the housing 10. Each of these three fixed contacts 100, 200, 300 may be connectable to an external electrical circuit with respect to the housing 10. The housing 10 may further be provided with a rotatable knife contact 400 positioned wholly in the interior of the housing 10. The rotatable knife contact 400 may be mounted on a roller 80 having an end portion protruding out from an opening 19 in the side plane 10F of the housing 10. The roller 80 may have a rotational axis Z1 extending in the thickness direction Z-Z of the housing 10. The rotational axis Z1 of the roller 80 may also form the rotational axis Z1 of the rotatable knife contact 400. The rotatable knife contact 400 is shown in FIG. 2.

The cross section of the housing 10 may be substantially rectangular.

FIG. 2 shows an exploded view of a pole of the electrical switch.

The pole of the electrical switch may comprise a rotatable roller 80 and a knife contact 400 supported on the roller 80.

The roller 80 may comprise a cylindrical main portion 81 provided with axial end portions 82, 83 at each axial end of the cylindrical main portion 81. The axial end portions 82, 83 may be cylindrical. The axial end portions 82, 83 may be fitted into circular openings 19 in the housing 10 as shown in FIG. 1. The roller 80 and thereby also the rotatable knife contact 400 is thus rotatable in respect of the housing 10. The first axial end portion 82 at the backside of the roller 80 may be identical to the second axial end portion 83 shown at the front side of the roller 80.

The roller 80 may further comprise two protrusions 84, 85 protruding out from the cylindrical main portion 81 of the roller 80. The protrusions 84, 85 may protrude diagonally in opposite directions from the circumference of the cylindrical portion 81 of the roller 80. A longitudinal center line of the protrusions 84, 85 is thus substantially perpendicular to the axial center line of the roller 80. One of the protrusions 84 may be formed of a separate part, which may be pushed into the cylindrical main portion 81. This removable protrusion 84 may be attached to the roller 80 with quick coupling means.

The knife contact 400 may comprise two longitudinal blades 410, 420 forming a pair of blades. The blades 410, 420 may be pushed into the cylindrical main portion 81 with the removable protrusion 84. The blades 410, 420 may extend through the roller 80 and they may protrude out from the outer ends of the protrusions 84, 85 in the roller 80.

The blades 410, 420 in the pair of blades may be attached to each other with a spring structure 50. The spring structure 50 may provide a flexible attachment of the blades 410, 420 to each other.

The third fixed contact 300 may be connected with a braided cable 31 to a longitudinal center portion 450 of the rotatable knife contact 400. The braided cable 31 may be electrically conductive.

The rotating knife contact 400 may comprises several parallel pairs of blades 410, 420. The number of pair of blades 410, 420 in the rotatable knife contact 400 depends on the nominal power of the switch. The current passing through the rotatable knife contact 400 may be divided into the branches of the pair of blades 410, 420 in the rotatable knife contact 400.

The blades 410, 420 in each pair of blades 410, 420 in the rotatable knife contact 400 may be connected flexibly to each other so that the blades due to a separating force acting on either end of the blades 410, 420 can take a V-shape. An increase of the distance between the first end 401 of the blades 410, 420 leads to a decrease of the distance between the second end 402 of the blades 410, 420 and vice a versa.

FIG. 3 shows a first inner view of the electrical switch.

The pole of the electrical switch is in a first switching position in this figure. The rotatable knife contact 400 is in the first switching position rotated into a position in which the first fixed contact 100 and the third fixed contact 300 are electrically connected to each other. The rotatable knife contact 400 is permanently electrically connected to the third fixed contact 300. The electrical connection between the first fixed contact 100 and the third fixed contact 300 is thus formed via the rotatable knife contact 400.

The first fixed contact 100, the second fixed contact 200, the third fixed contact 300, and the rotatable knife contact 400 have been fitted into the housing 10. The longitudinal direction Y-Y and the height direction X-X of the housing 10 is shown in the figure.

The first fixed contact 100 may comprise a connection portion 110 and a contact portion 120. The connection portion 110 of the first fixed contact 100 may be substantially straight. The connection portion 110 of the first fixed contact 100 may extend substantially in the longitudinal direction Y-Y of the housing 10 along a first connecting channel from the inside to the outside of the housing 10. The connection portion 110 of the first fixed contact 100 may thus be connected to an external electrical circuit with respect to the housing 10. The contact portion 120 of the first fixed contact 100 may be positioned fully within the housing 10. The contact portion 120 may comprise a first portion and a second portion. The first portion may have the shape of a reversed letter U. The two branches of the letter U may extend substantially perpendicularly inwards from the inner end of the connection portion 110. The second portion may have the shape of an arc. The second portion comprises thus two parallel arc-shaped portions whereby each portion forms a contact area 121. The use of two branches in the contact portion 120 is due to the fact that the rotatable contact 400 comprises two pairs of blades. The first curved contact area of the contact portion 120 of the first fixed contact 100 is received between the first pair of blades in the rotating contact 400. The second curved contact area of the contact portion 120 of the first fixed contact 100 is received between the second pair of blades in the rotating contact 400.

The second fixed contact 200 may be a mirror image of the first fixed contact 100. The second fixed contact 200 may thus comprise a connection portion 210 and a contact portion 220. The connection portion 210 of the second fixed contact 200 may be substantially straight. The connection portion 210 of the second fixed contact 200 may extend substantially in the longitudinal direction Y-Y of the housing 10 along a second connecting channel from the inside to the outside of the housing 10. The connection portion 210 of the second fixed contact 200 can thus be connected to an external electrical circuit with respect to the housing 10. The contact portion 220 of the second fixed contact 200 may be positioned fully within the housing 10. The contact portion 220 may comprise a first portion and a second portion. The first portion may have the shape of a reversed letter U. The two branches of the letter U may extend substantially perpendicularly inwards from the inner end of the connection portion 210. The second portion may have the shape of an arc. The second portion comprises thus two parallel arc-shaped portions whereby each portion forms a contact area 221. The use of two branches in the contact portion 220 is due to the fact that the rotatable contact 400 comprises two pairs of blades. The first curved contact area of the contact portion 220 of the second fixed contact 200 is received between the first pair of blades in the rotating contact 400. The second curved contact area of the contact portion 220 of the second fixed contact 200 is received between the second pair of blades in the rotating contact 400.

The contact force between the first fixed contact 100 and the movable knife contact 400 and between the second fixed contact 200 and the movable knife contact 400 may be reduced during the overlapping in order to reduce the operation torque needed to rotate the movable knife contact 400. This may be done e.g. by reducing the thickness of the contact area 121, 221 i.e. the overlapping area in the contact portion 120, 220 of the fixed contacts 100, 200. The tip of the arcs 121, 221 may have a smaller thickness compared to the inner portion of the arcs 121, 221. The contact force acting on the ends 401, 402 of the blades 410, 420 of the movable knife contact 400 is thus smaller near the tips of the arcs 121, 221 i.e. in the overlapping area of the fixed contacts 100, 200.

The connection portion 110 of the first fixed contact 100 and the connection portion 210 of the second fixed contact 200 may be parallel and positioned at a distance from each other on opposite sides of a longitudinal Y-Y center line of the housing 10. The connection portion 110 of the first fixed contact 100 and the connection portion 210 of the second fixed contact 200 may form mirror images of each other.

The third fixed contact 300 may comprise a connection portion 300 and a contact portion 320 being substantially perpendicular to each other. The connection portion 310 of the third fixed contact 300 may extend in a longitudinal direction Y-Y of the housing 10 along a third connection channel from the inside to the outside of the housing 10. The connection portion 310 of the third fixed contact 300 may extend along the longitudinal Y-Y center line of the housing 10. The contact portion 320 of the third fixed contact 300 may be seated against a first support surface 12A inside the housing 10. The third fixed contact 300 may have the shape of a letter L or the shape of a letter T. A free contact surface is thus formed on the contact portion 320 of the third fixed contact 300 within the housing 10.

The third fixed contact 300 may be positioned in a longitudinal direction Y-Y on an opposite side of a rotational axis Z1 of the rotatable knife contact 400 in relation to the first and the second fixed contact 100, 200. The third fixed contact 300 may be positioned in a longitudinal direction Y-Y on an opposite side of a plane extending along the rotational axis Z1 of the rotatable knife contact 400 in a transverse direction X-X to the longitudinal direction Y-Y in relation to the first and the second fixed contact 100, 200. The transverse plane X-X may pass in the height direction X-X of the housing 10. The transverse plane X-X may divide the housing 10 into two opposite sides. The third fixed contact 300 is thus positioned on one side of the transverse plane whereas the first and the second fixed contact 100, 200 are positioned on the opposite side of the transverse plane.

The third fixed contact 300 is thus located on the opposite side of the housing 10 in respect of the first fixed contact 100 and the second fixed contact 200. The first support surface 12A may extend in the height direction X-X of the housing 10. The contact portion 320 of the third fixed contact 300 may have an outwardly from the housing 10 directed face, which may seat against the first support surface 12A of the housing 10 and a free contact surface directed to the interior of the housing 10.

By forming the third fixed contact 300 into the shape of a letter L or a letter T, a support surface can be formed inside the housing 10 against which the contact portion 320 of the third fixed contact 300 can be supported. The third fixed contact 300 can thus be secured firmly to the housing 10.

The connection portion 310 of the third fixed contact 300 may be connected by at least one braided cable 31 to a middle portion 450 of the rotatable knife contact 400. One end of the braided cable 31 may be attached to the free contact surface of the third fixed contact 300 by welding, soldering or with a pressure joint. The other end of the braided cable 31 may be attached to the middle portion 450 of the rotatable knife contact 400 by welding, soldering or with a pressure joint. The middle portion 450 of the rotatable knife contact 400 may be provided with a protrusion for attaching the braided cable 31. The braided cable 31 form an electrical connection between the third fixed contact 300 and the rotatable knife contact 400.

The attachment of the braided cable 31 to the contact portion 320 of the third fixed contact 300, makes it possible to use a longer braided cable 31 which means that more play for the braided cable 31 is achieved. A flexible joint that withstands well movement of the rotatable knife contact 400 is thus achieved between the third fixed contact 300 and the rotatable knife contact 400.

The third fixed contact 300 is thus connected with a permanent electrical connection to the middle portion 450 of the rotatable knife contact 400. Both ends 401, 402 of the blades 410, 420 in the rotatable knife contact 400 are thus free to form switching. The pole of the transfer switch 500 may thus be realized with one rotatable knife contact 400 and two separate contact chambers.

The rotatable knife contact 400 may comprise at least one longitudinal pair of blades with two opposite outer ends 401, 402. The rotatable knife contact 400 rotates in respect of the housing 10 around a rotational axis Z1 extending in the thickness direction Z-Z of the housing 10.

The rotatable knife contact 400 is in this figure shown in a first switching position in which a first outer end 401 of the rotatable knife contact 400 makes contact to the contact portion 120 of the first fixed contact 100. An electrical connection is thus formed between the first fixed contact 100 and the third fixed contact 300. A second outer end 402 of the rotatable knife contact 400 remains open in this first switching position.

The rotational axis Z1 of the rotatable knife contact 400 may be located at a middle portion of the blades in the rotatable knife contact 400. The opposite outer ends 401, 402 of the blades are thus free to make contact with the contact portion 120, 220 of the first and the second fixed contact 100, 200.

The rotatable knife contact 400 may be supported on a roller 80 positioned within the housing 10. The rotational axis Z1 of the roller 80 forms also the rotational axis Z1 of the rotatable contact 400.

The housing 10 may comprise a first chamber 13A and a second chamber 13B. The first chamber 13A and the second chamber 13B may be on opposite sides of a longitudinal center line of the housing 10. The contact portion 120 of the first fixed contact 100 may be positioned in the first chamber 13A. The contact portion 220 of the second fixed contact 200 may be positioned in the second chamber 13B. The first end 401 of the blades of the rotatable knife contact 400 may, in a switching event, move within the first chamber 13A and the second end 402 of the blades of the rotatable contact 400 may, in a switching event, move within the second chamber 13B.

The housing 10 may also comprise two stoppers 16A, 16B extending inwards into the housing 10 from the second side wall 10B. The two stoppers 16A, 16B may limit the rotational movement of the rotatable knife contact 400.

When the rotatable knife contact 400 is turned counterclockwise into a first switching position, the first end 401 of the rotatable knife contact 400 may form an electrical contact to the contact portion 120 of the first fixed contact 100. The opposite second end 402 of the rotatable knife contact 400 may at the same time turn against a second stopper 16B which may stop the counterclockwise turn of rotatable knife contact 400. The second end 402 of the rotatable knife contact 400 is disconnected from any electrical contact in this first switching position.

When the rotatable knife contact 400 is rotated clockwise into a second switching position, the second end 402 of the rotatable knife contact 400 may form an electrical contact to the contact portion 220 of the second fixed contact 200. The opposite first end 401 of the rotatable knife contact 400 may at the same time turn against a first stopper 16A which may stop the clockwise turn of the rotatable knife contact 400. The first end 401 of the rotatable knife contact 400 is disconnected from any electrical contact in this second switching position.

These two stoppers 16A, 16B may also function as limiting walls of the chambers 13A, 13B near the second side wall 10B in the housing 10. There may further be walls 16C, 16D between the fixed contacts 100, 200 extending inwards from the first side wall 10A of the housing 10. These walls 16C, 16D may be provided with stopper portions positioned substantially diametrically opposite to the two stoppers 16A, 16B at the second side wall 10B of the housing 10. The stopper portions may limit the rotational movement of the rotatable knife contact 400.

FIG. 4 shows a second inner view of the electrical switch.

The pole of the electrical switch is in a second switching position in this figure. The rotatable knife contact 400 is in the second switching position rotated into a position in which only the second fixed contact 200 and the third fixed contact 300 are electrically connected to each other. The rotatable knife contact 400 is permanently electrically connected to the third fixed contact 300. The electrical connection between the second fixed contact 200 and the third fixed contact 300 is thus formed via the rotatable knife contact 400.

The rotatable knife contact 400 has been rotated clockwise into a second switching position. The second outer end 402 of the rotatable knife contact 400 forms an electrical connection with the contact portion 220 of the second fixed contact 200. The opposite first outer end 401 of the rotatable knife contact 400 may at the same time turn against a first stopper 16A which may stop the clockwise turn of the rotatable knife contact 400. The first outer end 401 of the rotatable knife contact 400 remains open i.e. electrically isolated in the second switching position.

The outer ends 401, 402 ends of the rotatable knife contact 400 may thus be utilized alternatively in the switching operation when the rotatable knife contact 400 is turned between the first switching position and the second switching position.

FIG. 5 shows a third inner view of the electrical switch.

The pole of the electrical switch is in a zero switching position in this figure. The rotatable knife contact 400 is in the zero switching position rotated into a position in which the first fixed contact 100, the second fixed contact 200 and the third fixed contact 300 are electrically connected to each other. The rotatable knife contact 400 is permanently electrically connected to the third fixed contact 300. The first fixed contact 100, the second fixed contact 200 and the third fixed contact 300 are thus electrically connected to each other via the rotatable knife contact 400.

The rotatable knife contact 400 is shown in a zero switching position between the first switching position and the second switching position in this figure. The first outer end 401 of the rotatable contact 400 is electrically connected with the contact portion 120 of the first fixed contact 100 and the second outer end 402 of the rotatable contact 400 is electrically connected with the contact portion 220 of the second fixed contact 200. The rotatable knife contact 400 is permanently electrically connected to the third fixed contact 300. The first fixed contact 100, the second fixed contact 200 and the third fixed contact 300 are thus electrically connected to each other via the rotatable knife contact 400 in this zero switching position.

There is thus an overlapping between the first fixed contact 100 and the second fixed contact 200 in the zero switching position between the first switching position and the second switching position. The overlapping takes place only for a short time period during the transition between the switching positions. The contacts in the electrical switch are thus arranged to "make-before-break". The rotatable knife contact 400 makes contact to the first fixed contact 100 before breaking the contact to the second fixed contact 200 and to the second fixed contact 200 before breaking the contact to the first fixed contact 100 when the switching position is changed.

The third fixed contact 300 may instead of a single L-shaped contact 320 be made of two L-shaped contacts forming a T-shaped contact or of a single T-shaped contact.

The housing 10 and the roller 80 of the electric switch 500 may be made of an electrically insulating material, e.g., of plastic.

The first, the second and the third fixed contact 100, 200, 300 as well as the blades 410, 420 in the rotatable knife contact 400 may be of electrically conductive material, e.g. pure copper (Cu). The copper in these contacts may be coated with silver (Ag). The silver coating may reduce the contact resistance and protect the copper from oxidation. Copper and silver may form the first material composition.

The copper in the third fixed contact 300 may be coated with tin (Sn). Tin is cheaper than silver and there is no need for the low contact resistance provided by silver in the third fixed contact 300. The third fixed contact 300 is permanently electrically connected to the rotatable knife contact 400. Tin may also function as an intermediate material when the braided cable 31 is welded to the third fixed contact 300.

The braided cable 31 may also be of electrically conductive material, e.g. copper. The braided cable 31 can be made of very thin strands so that the braided cables become elastic. The horizontal arm 320 of the third fixed contact 300 may be coupled with one or several braided cables to the middle portion 450 of the rotatable knife contact 400. The braided cable 31 becomes elastic when the thickness thereof i.e. the number of strands therein is not too high. The braided cable 31 must, however, have a certain cross section area in order to have a sufficient current-carrying capacity. By using very thin strands, a smooth movement is achieved, but the number of strands increases.

An electrical switch 500 according to the invention may be an automatic electric switch, the rotatable knife contact 400 being rotated through an actuator. The actuator may be, for example, a solenoid whose linear movement is converted into a rotational motion by means of a power transmission apparatus. The power transmission apparatus may rotate the roller 80 clockwise or counterclockwise and thereby move the rotatable knife contact 400 between the contact positions. The actuator may also comprise a spring for returning the rotatable knife contact 400 to the zero position.

An electrical switch 500 according to the invention can act as a transfer switch e.g. in a hospital environment. In the hospital, there is a need to connect a load to a primary power supply or to a secondary power supply, whereby the primary power supply is an electrical network and the secondary power supply is a backup power plant. The load is thus coupled to the third fixed contact and the primary power source to the first or second fixed contact and the secondary power source correspondingly to the second or first fixed contact. Depending on the position of the electrical switch 500, the load can be supplied either from the electrical network or from the backup power supply. By connecting a sufficient number of electrical switches 500 in parallel, a multi-phase transfer or changeover switch is provided. In a hospital, the load may be formed, for example, by the power needed in an operating room, where breaks in the power supply cannot be accepted.

The electrical switch 500 according to the invention may be used for connecting the neutral connector. The neutral connector must in some applications, e.g. in data centers, be continuously connected during a switching event from line power to reserve power. This may be achieved with the make-before-brake electrical switch 500. The current and the voltage are normally small in the neutral conductor i.e. there is no arc in the switching event. There is thus no need for extinguishing chambers provided with extinguishing plates in this kind of an electrical switch 500. The position of the extinguishing chambers are visible in the figures due to the fact that the same frame type may also be used in electrical switches 500 where extinguishing chambers provided with extinguishing plates are used.

The electrical switch 500 according to the invention may naturally also be used for connecting the phase connectors. There are applications, e.g. DC-power source/accumulator, battery power supply, where the switchover between the power supplies must be done without any interruption in the power supply.

An electrical switch 500 according to the invention may be manufactured for a nominal current range of 100 to 1600 amperes.

The invention and its embodiments are not limited to the examples shown in the figures, but the invention may vary within the scope of the protection defined by the claims.

The invention claimed is:

1. An electrical switch comprising:

a first fixed contact, a second fixed contact, a third fixed contact, a rotatable knife contact being connected with a permanent electrical connection to the third fixed contact, the rotatable knife contact comprising at least one longitudinal pair of blades flexibly connected to each other with a spring structure, the rotatable knife contact having a first switching position in which a first outer end of the blades makes contact with the first fixed contact connecting only the first fixed contact and the third fixed contact electrically to each other, and a second switching position in which a second outer end of the blades makes contact with the second fixed contact connecting only the second fixed contact and the third fixed contact electrically to each other, a contact portion of the first fixed contact comprises a contact area having the form of an arc and a contact portion of the second fixed contact comprises a contact area having the form of an arc, the outer ends of the blades of the rotatable knife contact making contact with said contact areas during the switching operation of the electrical switch, the rotatable knife contact has further a zero switching position between the first switching position and the second switching position in which zero switching position the first outer end of the blades makes contact with the contact area of the contact portion of the first fixed contact and the second outer end of the blades makes contact with the contact area of the contact portion of the second fixed contact connecting the first fixed contact, the second fixed contact and the third fixed contact electrically to each other.

2. The electrical switch according to claim 1, wherein the thickness of the contact areas is reduced in relation to the thickness of the rest of the contact portions of the first and the second fixed contact in order to reduce the contact force between the blades in the rotatable knife contact and the first and the second fixed contacts in the zero switching position.

3. The electrical switch according to claim 1, wherein p longitudinal middle portion of the rotatable knife contact is connected with at least one electrically conductive, flexible braided cable to the third fixed contact.

4. The electrical switch according to claim 1, wherein the electrical switch comprises a housing, the first, the second and the third fixed contact being fixedly arranged in the housing, and the rotatable knife contact being arranged to be rotatable around a rotational axis in the housing.

5. The electrical switch according to claim 4, wherein the housing comprises a first side wall and a second side wall being opposite to and spaced apart from the first side wall in a longitudinal direction of the housing.

6. The electrical switch according to claim 5, wherein the third fixed contact is positioned in the longitudinal direction on an opposite side of the rotational axis of the rotatable knife contact in relation to the first and the second fixed contact.

7. The electrical switch according to claim 1, wherein the rotational knife contact is rotatable around a rotational axis passing through a longitudinal middle portion of the blades.

8. The electrical switch according to claim 7, wherein the longitudinal middle portion of the rotatable knife contact is connected with at least one electrically conductive, flexible braided cable to the third fixed contact.

9. The electrical switch according to claim 7, wherein the third fixed contact is positioned in a longitudinal direction on an opposite side of the rotational axis of the rotatable knife contact in relation to the first and the second fixed contact.

10. The electrical switch according to claim 9, wherein the electrical switch comprises a housing, the first, the second and the third fixed contact being fixedly arranged in the housing, and the rotatable knife contact being arranged to be rotatable around a rotational axis in the housing.

11. The electrical switch according to claim 9, wherein the longitudinal middle portion of the rotatable knife contact is connected with at least one electrically conductive, flexible braided cable to the third fixed contact.

12. The electrical switch according to claim 11, wherein the electrical switch comprises a housing, the first, the second and the third fixed contact being fixedly arranged in the housing, and the rotatable knife contact being arranged to be rotatable around a rotational axis in the housing.

13. The electrical switch according to claim 12, wherein the rotatable knife contact is supported on a rotatable roller comprising a cylindrical main portion and two axial end portions being fitted into circular openings in the housing, wherein the roller and thereby also the rotatable knife contact become rotatable in respect of the housing.

14. The electrical switch according to claim 12, wherein the housing comprises a first side wall and a second side wall being opposite to and spaced apart from the first side wall in a longitudinal direction of the housing.

15. The electrical switch according to claim 14, wherein the first fixed contact comprises a connection portion and a contact portion, the second fixed contact comprises a connection portion and a contact portion, and the third fixed contact comprises a connection portion and a contact portion, the connection portion of the first fixed contact and the connection portion of the second fixed contact passing through the first side wall of the housing and the connection portion of the third fixed contact passing through the second side wall of the housing.

16. The electrical switch according to claim 14, wherein the third fixed contact is positioned in the longitudinal direction on an opposite side of the rotational axis of the rotatable knife contact in relation to the first and the second fixed contact.

17. The electrical switch according to claim 16, wherein the first fixed contact comprises a connection portion and a contact portion, the second fixed contact comprises a connection portion and a contact portion, and the third fixed contact comprises a connection portion and a contact portion, the connection portion of the first fixed contact and the connection portion of the second fixed contact passing through the first side wall of the housing and the connection portion of the third fixed contact passing through the second side wall of the housing.

18. The electrical switch according to claim 17, wherein the longitudinal middle portion of the rotatable knife contact is connected to the contact portion of the third fixed contact with at least one electrically conductive, flexible braided cable.

19. The electrical switch according to claim 17, wherein the rotatable knife contact is supported on a rotatable roller comprising a cylindrical main portion and two axial end portions being fitted into circular openings in the housing, wherein the roller and thereby also the rotatable knife contact become rotatable in respect of the housing.

20. The electrical switch according to claim 19, wherein the longitudinal middle portion of the rotatable knife contact is connected to the contact portion of the third fixed contact with at least one electrically conductive, flexible braided cable.

* * * * *